United States Patent [19]

Speicher

[11] Patent Number: 4,703,702

[45] Date of Patent: Nov. 3, 1987

[54] MULTI-LEVEL PALLET ASSEMBLY

[75] Inventor: Alan Speicher, Paris, Ill.

[73] Assignee: Ready Metal Manufacturing Company, Chicago, Ill.

[21] Appl. No.: 920,152

[22] Filed: Oct. 16, 1986

[51] Int. Cl.[4] ..... B65D 19/12

[52] U.S. Cl. ..... 108/56.3; 108/53.1; 108/52.1; 182/178; 211/188; 211/194

[58] Field of Search ..... 108/53.1, 53.5, 56.1, 108/91, 111, 56.3; 182/178; 211/188, 194, 189

[56] References Cited

U.S. PATENT DOCUMENTS

| | | | |
|---|---|---|---|
| 2,639,112 | 4/1948 | Cushman | 108/56.3 |
| 3,741,404 | 6/1973 | Jourdain | 108/91 |
| 4,199,069 | 4/1980 | Talarilo | 211/194 |

FOREIGN PATENT DOCUMENTS

| | | | |
|---|---|---|---|
| 0566193 | 4/1958 | Belgium | 211/188 |
| 0012759 | 12/1909 | Denmark | 108/111 |
| 2287873 | 6/1976 | France | 211/194 |
| 2301657 | 10/1976 | France | 182/178 |
| 0430097 | 8/1967 | Switzerland | 108/53 B |

*Primary Examiner*—Kenneth J. Dorner
*Assistant Examiner*—Gerald A. Anderson
*Attorney, Agent, or Firm*—Balogh, Osann, Kramer, Dvorak, Genova & Traub

[57] ABSTRACT

An assembly for supporting load carrying pallets which is collapsible and storable when not in use and which includes a rigid base member for holding a pallet and removable upright members which engage one base member and support another base member.

6 Claims, 3 Drawing Figures

MULTI-LEVEL PALLET ASSEMBLY

BACKGROUND OF THE INVENTION

1. Field of the Invention

This invention is generally concerned with an apparatus for storing articles on a pallet, and is more particularly directed to an assembly of pallets, one upon the other, in a spaced relationship to provide several layers of arranged pallets.

2. Description of the Prior Art

A warehouse is generally provided with a rack arrangement having multiple storage levels arranged vertically in such manner as to enable a hoisting vehicle provided with a fork which is engaged underneath a pallet filled with articles, the pallet being hoisted by the vehicle to the desired bin in the racking arrangement, which is a permanent installation. Occasionally, it is desired to set up a temporary storage facility without requiring the use of a racking arrangement.

SUMMARY OF THE INVENTION

To dispense with the permanent racking arrangement, a multi-level pallet assembly is presented wherein several pallets can be arranged vertically, one above the other, and held together by a strut assembly which interconnects succeeding levels of pallets which can be readily assembled or disassembled as a need requires. The strut assembly is constructed by members pivotally interconnected so that the strut assembly can be collapsed and conveniently stored without requiring any extensive storage space.

The main object of the invention is to provide a multi-level pallet assembly having two or more pallets vertically spaced from each other.

Another object of the invention is to provide a base which supports a pallet and which is stackable on a storable strut assembly.

A still further object of the invention is to provide a strut assembly having pivotally interconnected shanks for defining a spacing arrangement between two vertically spaced pallets.

DESCRIPTION OF THE PREFERRED EMBODIMENT

Figure 1:
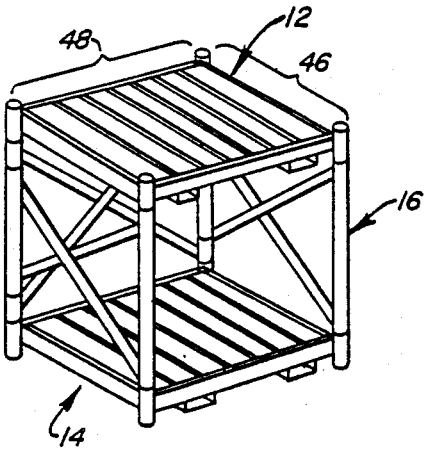
FIG. 1 shows a multi-level pallet assembly.

Referring to FIG. 1, there is shown a multi-level pallet assembly comprising a pallet and pallet base 12 vertically disposed to a pallet and pallet base 14 by means of a strut assembly 16. The pallet and pallet bases 12 and 14 have identical construction, and only pallet and pallet base 12 will be described in detail.

Pallet and pallet base 12 comprises a base 18 having frame members 20–23 interconnected by tubular connectors 24–27. The frame members 20 and 21 are interconnected by spacers 28–30. The frame members 20–23 and the spacers 28–30 are rigidly interconnected by a pair of U-shaped channel members 32 and 34 which also function as providing channels for admitting a forked member (not shown) on a fork vehicle.

The base 18 supports a pallet 36 comprising a plurality of extending members 38 interconnected by and supported by ridge members 40 and 42. The extending members 38 extend outwardly beyond the ridge members 40 and 42 so that extensions 44, when the pallet 36 is positioned over and into the base 18, will rest on top of the frame members 22 and 23. Alternatively, the pallet may be disposed at an angle of ninety degrees about a vertical axis, whereby ridge members 40 and 42 will rest upon and be supported by spacers 28, 29, and 30.

As best viewed in FIG. 1, the depth 46 is less than the width 48, for reasons to be explained later. The pallet 36 is snugly fitted on top of the base 18 so that, at all times, the pallet 36 and the base 18 form an integral unit.

Figure 3:
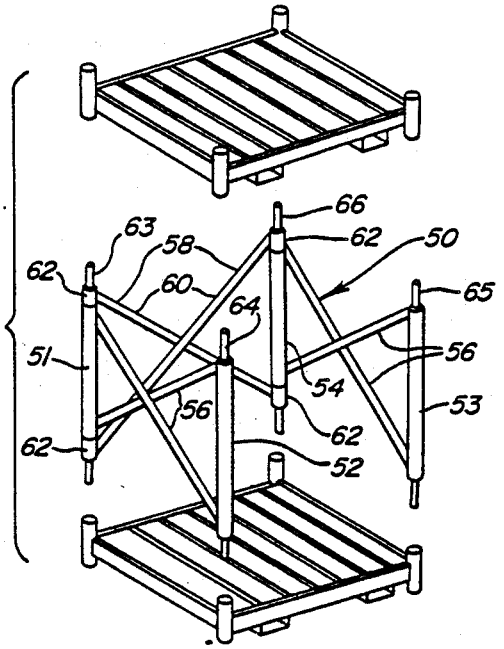
FIG. 3 shows an exploded view of assembled components comprising the pallet assembly.

Referring to FIG. 3, there is shown a strut assembly 50 comprising four shanks 51–54 arranged in a rectangular formation and interconnected by struts, as will be now described in a detailed manner.

The shanks 53 and 54 are permanently connected together by struts 56, as by welding. Similarly, the shanks 51 and 52 are connected by the struts 56. The shanks 51 and 54 are spaced from each other by strut couplers 58, each of which comprises a strut 60 terminating in tubular couplings 62. The shanks 51–54 are hollow or tubular and admit stacking rods 63–66. The length of the shanks 52 and 53 is the same. The length of the shank 52 is equal to the length of the shank 51 plus the lengths of the tubular couplings 62. The rods 64 and 65 are welded to the shanks 52 and 53, respectively. The tubular couplings 62 are spot welded to the rods 63 and 66, respectively. The shanks 51 and 54 are pivotally secured on the respective rods 63 and 66 by the spot welded tubular couplings 62.

This pivotal connection of the shanks 51 and 54 on their respective stacking rods 63 and 66 permits the strut assembly 50 to be collapsed into a compact shape. In other words, referring to FIG. 3, if it is necessary to collapse the strut assembly 50, the shank 52 can be pivoted inwardly toward the shank 54 until it rests on the struts 60. Then, the shank 53 can be pivoted inwardly toward the shank 51 to rest on top of the struts 56 interconnecting the shanks 51 and 52.

As was stated earlier in reference to FIG. 1, the depth 46 of the assembly is less than the width 48. Similarly, the spacing between the shanks 51 and 52, as well as the shanks 53 and 54, is less than the spacing between the shanks 51 and 54, so that, when the strut assembly 50 is collapsed, the shank 52 will lie inside of the shank 54, and the shank 53 will lie inside of the shank 51.

As shown in FIG. 3, there is a pallet assembly having two pallets for vertical stacking. If a further level of stacking is required, a second strut assembly 50 would be used together with an additional pallet and pallet base 12.

The extending members 38 and the ridge members 40 and 42 can be made of any suitable material, preferably from wood. The struts 56 and 60, as shown in FIG. 3, overlap each other to form an X-formation. These struts are preferably made from metal and will bend slightly with respect to each other so as to cause no problem during the X-crossover. The remaining components of the pallet assembly are made from metal. The pivotal connection established between the shanks 51 and 54 with the rods 63 and 66, respectively, has a loose fit.

Figure 2:
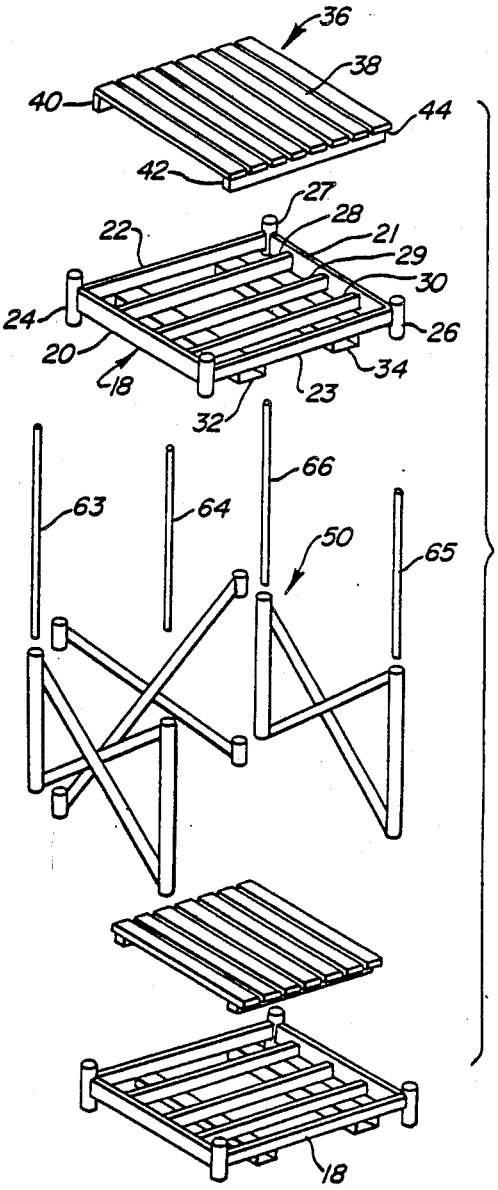
FIG. 2 shows an exploded view of the components comprising the pallet assembly.

The central portion of FIG. 2 shows an exploded view of the strut assembly 50 as it would be assembled on the rods 63–66 prior to spot welding the strut couplers 58 and the shanks 52 and 53 to the respective rods.

What is claimed as new and desired to be protected by Letters Patent is set forth in the appended claims:

1. A readily collapsible pallet assembly for two or more levels of stacking, comprising at least two pallet means, each having a plurality of rectangularly-spaced tubular connectors, a strut assembly having a predetermined vertical elevation, said assembly having a plurality of rectangularly-spaced, vertically-extending members, complementarily disposed with respect to said connectors, said strut assembly including a plurality of struts interconnecting said vertically-extending members to form two units defining two sides of a cubicle, strut couplers interconnecting a pair of selected vertically-extending members, one from each unit, to form a back side of said cubicle, and elongated members extending through said extending members for detachably engaging said tubular connectors on said pallet means in a vertically-spaced arrangement, one pair of said elongated members pivotally supporting said selected vertically-extending members to permit inward collapsing of said two sides with respect to said back side after said pallet means have been disenaged from said elongated members.

2. A pallet assembly according to claim 1, wherein each said means comprises a base and a pallet superimposed on said base, said base comprising rectangularly-spaced frame members forming corners defined by tubular members, a pair of "U"-shaped channel members secured to the bottom of said base, said pallet defining a stcking level and snug-fitted within said frame members.

3. A pallet assembly according to claim 1, wherein said vertically-extending members comprise shanks, and said elongated members comprise stacking rods, wherein each unit has one shank being rigidly secured on its respective stacking rod and the respective selected shank being pivotally secured to its respective rod, and including a pair of strut couplers, each of said strut couplers having a strut terminating in tubular couplings rigidly secured to its respective rod.

4. A pallet assembly according to claim 1, wherein said vertically-extending members are arranged to define three sections, a central section and a pair of folding sections, said central section comprising a pair of stacking rods spaced from each other by a pair of strut couplers defining a pivotal area on the respective rods, each folding section comprising a pair of tubular members spaced from each other by struts, said elongated members comprising stacking rods, each tubular member being traversed by a stacking rod, one member pivotally secured on the rod between said strut couplers and the other member rigidly secured to its respective rod, whereby said pivotally secured members permit the folding sections to pivot with respect to the central section.

5. A pallet assembly according to claim 4, wherein the length of the tubular member rigidly secured to its respective rod is equal to the length of the pivotally secured tubular member plus the lengths of said strut couplers defining said pivotal area.

6. A pallet assembly according to claim 4, wherein each stacking rod has a pair of protruding ends engageable with respective tubular connectors on said pallet bases.

* * * * *